US005411652A

United States Patent [19]

Smith et al.

[11] Patent Number: 5,411,652

[45] Date of Patent: May 2, 1995

[54] OPTIMUM CONVERSION CHAMBER

[75] Inventors: Jeffrey K. Smith, Clarksville, Tenn.; Sean A. Stapulionis, Aurora, Ohio

[73] Assignee: AlliedSignal Inc., Morristown, N.J.

[21] Appl. No.: 167,495

[22] Filed: Dec. 15, 1993

[51] Int. Cl.[6] ..... C25D 5/02; C25D 11/02; C25D 17/00; C25D 21/12

[52] U.S. Cl. ..... 204/224 R; 204/237; 204/275; 204/239; 204/269; 118/429

[58] Field of Search ..... 204/224 R, 275, 237, 204/239; 118/429

[56] References Cited

U.S. PATENT DOCUMENTS

| | | | |
|---|---|---|---|
| 3,857,772 | 12/1974 | Sasaki et al. | 204/275 X |
| 4,069,127 | 1/1978 | Salemi et al. | 204/275 X |
| 4,093,530 | 6/1978 | Suslin et al. | 204/275 X |
| 4,139,446 | 2/1979 | Suslin et al. | 204/224 R |
| 5,057,202 | 10/1991 | Maitino et al. | 204/275 X |
| 5,279,725 | 1/1994 | Westerman, Jr. | 204/224 R X |

*Primary Examiner*—Donald R. Valentine
*Attorney, Agent, or Firm*—Leo H. McCormick, Jr.; Larry J. Palguta

[57] ABSTRACT

An electrochemical processor having a first frustoconical chamber for receiving a workpiece to be processed. A plurality of sources of process fluids are connected to the frustoconical chamber for sequentially cleaning, providing an electrolyte and sealing the surface of the workpiece. A first valve arrangement connected to the chamber and responsive to a signal from a central processing unit allows the selected fluid to recirculate to provide agitation and at the same time if need to either chill or heat the selected fluid to aid in the desired function of the selected fluid. A second valve arrangement responsive to a signal from the central processing unit allows the selected fluid to drain from the chamber for return to the original supply source or a second frustoconical chamber for processing workpieces in parallel with the first frustoconical chamber.

11 Claims, 2 Drawing Sheets

OPTIMUM CONVERSION CHAMBER

The present invention relates generally to electrochemical processes and apparatus for carrying out such processes, and more particularly to a chamber and related apparatus for the anodizing of aluminum.

BACKGROUND OF THE INVENTION

Electrochemical processing generally, and anodizing in particular is characteristically a batch processing technique wherein a workpiece or array of workpieces are lowered into a tank for one processing step, raised from that tank and then lowered into another tank for a subsequent processing step. Such batch processing techniques are typically large, expensive and hard to control.

U.S. Pat. No. 2,111,377 discloses such a batch processing anodizing tank where workpieces are suspended in an electrolyte solution within the tank and having an air circulating pump for agitating the solution as well as an exhaust fan for removal of noxious fumes. Another batch processing tank is shown in U.S. Pat. No. 3,971,710 wherein the electrolyte solution is recirculated between the tank and a second constant temperature reservoir.

In U.S. Pat. No. 4,081,347 illustrates another batch processing technique for electroplating wherein a partition arrangement within the tank maintains the separation of potentially explosive gases evolved at the anode and cathode, respectively. The electrolyte is subsequently removed from the tank, degassed, and returned to the tank in two separate recirculating paths to maintain that gas separation.

SUMMARY OF THE INVENTION

In each of these prior art arrangements, the tank or vessel in which the electrochemical process is carried out is generally of a rectangular parallelepiped shape, where its main function is dedicated to the formation of the anodic coating in the present invention, a single chamber, shaped like two frustoconical halves joined at their bases, is used for the entire electrochemical process which includes but not limited to cleaning, anodizing and sealing of a workpiece. The frustoconical shape results in a process fluid contact surface that drains efficiently while offering suitable internal volume. This frustoconical shape also allows for an adequate cathode to anode air gap for a myriad of cathode arrangements.

The present invention offers the advantage of a "cellular" processing as opposed to the batch electrochemical processing technique of the prior art. This cellular processing is achieved by an electrochemical processing chamber having a frustoconical geometrical design for facilitating the ingress and egress of liquids. Further, the provision of an electrochemical processing system is characterized by its ease of operation and its adaptability to many different processing tasks in addition to easily and quickly monitored and controlled processing parameters of the anodizing system to uniformly develop an oxide coating on a clean surfaced of a workpiece in a cost effective manner. These as well as other objects and advantageous features of the present invention will be in part apparent and in part pointed out hereinafter.

In general, the present invention is a electrochemical processor which has an electrochemical chamber for receiving the workpieces to be processed wherein processing fluids are selectively supplied to the chamber. The chamber has a frustoconical shape which facilitates draining and removal of liquid from the chamber. With this arrangement, one liquid may be supplied to the chamber for initial workpiece processing and subsequent to drainage of that liquid by way of the chamber drain, to immediately supply a second liquid to the chamber for subsequent electrochemical workpiece processing, and so on for the remaining process fluids. All of this takes place without the removal of the workpieces from the chamber or any other need to handle individual parts.

In another embodiment of the invention, an electrochemical processor has at least two separate electrochemical chambers, each of these chambers being adapted for processing workpieces. This arrangement facilitates having some process parameters differences such as; anode to cathode ratios, time etc., while holding others constant such as; type, concentration and temperature of electrolyte. With this arrangement, the electrolyte may be supplied to a first chamber for electrochemical processing of workpieces in that chamber and subsequent to drainage of that liquid electrolyte from the first chamber and supplying that liquid electrolyte solution to a second chamber for subsequent electrochemical processing of workpieces in the second chamber without removal of the workpieces from either chamber or any other need to handle individual parts. Thus, efficiency is achieved since the same electrolyte may be shared by the first and second chambers. Further more than one liquid may be employed so that each operating chamber is utilizing one then subsequent other liquids in the process.

DESCRIPTION OF THE INVENTION

DETAILED DESCRIPTION OF THE INVENTION

Figure 1:
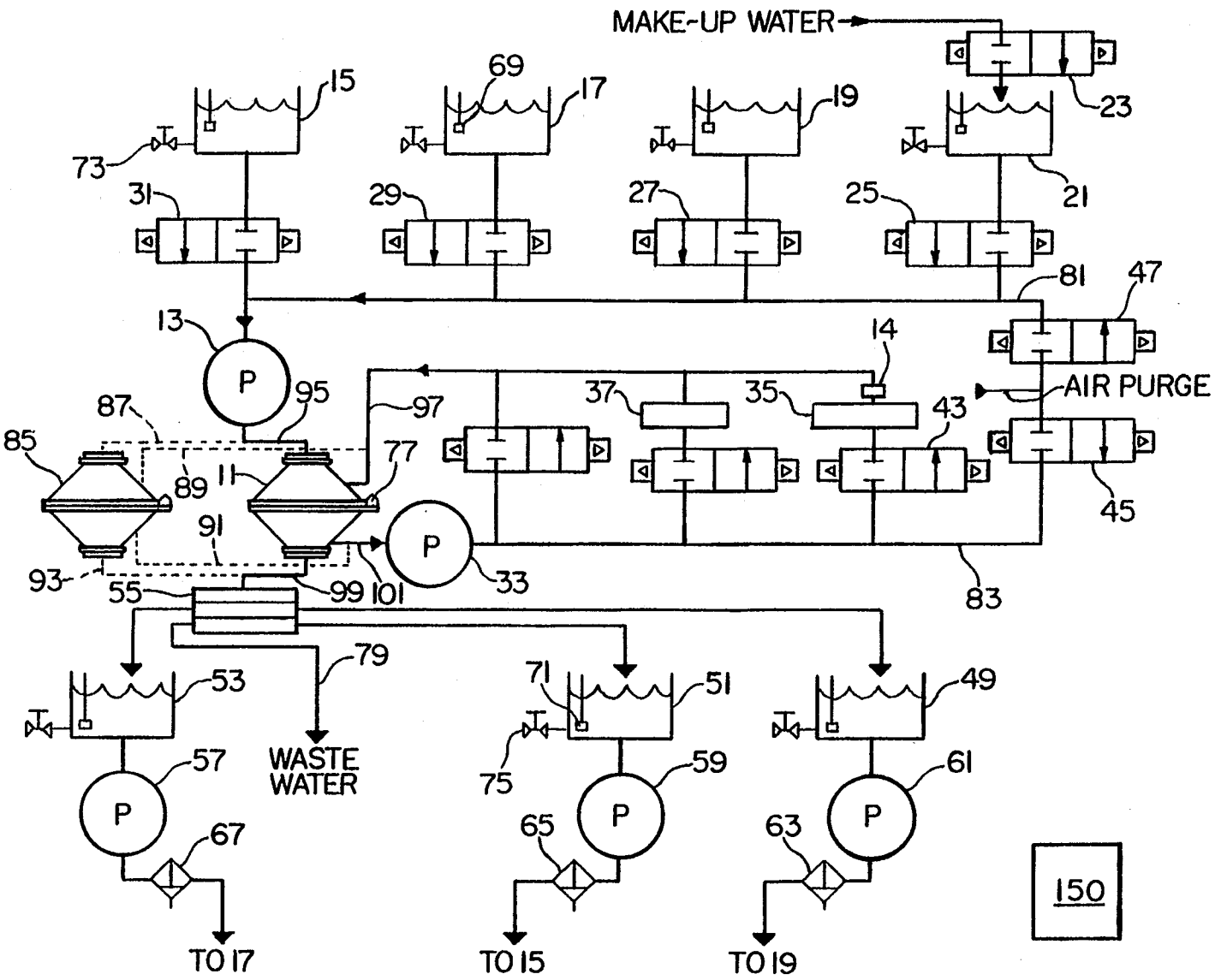
FIG. 1 is a schematic representation of the fluid transfer paths in the apparatus for practicing the present invention.

Corresponding reference characters indicate corresponding parts throughout the drawings. The electrochemical process described herein has been performed in anodizing of aluminum alloys, however similar results could be expected for other metallic workpieces using the same structural components.

Figure 2:
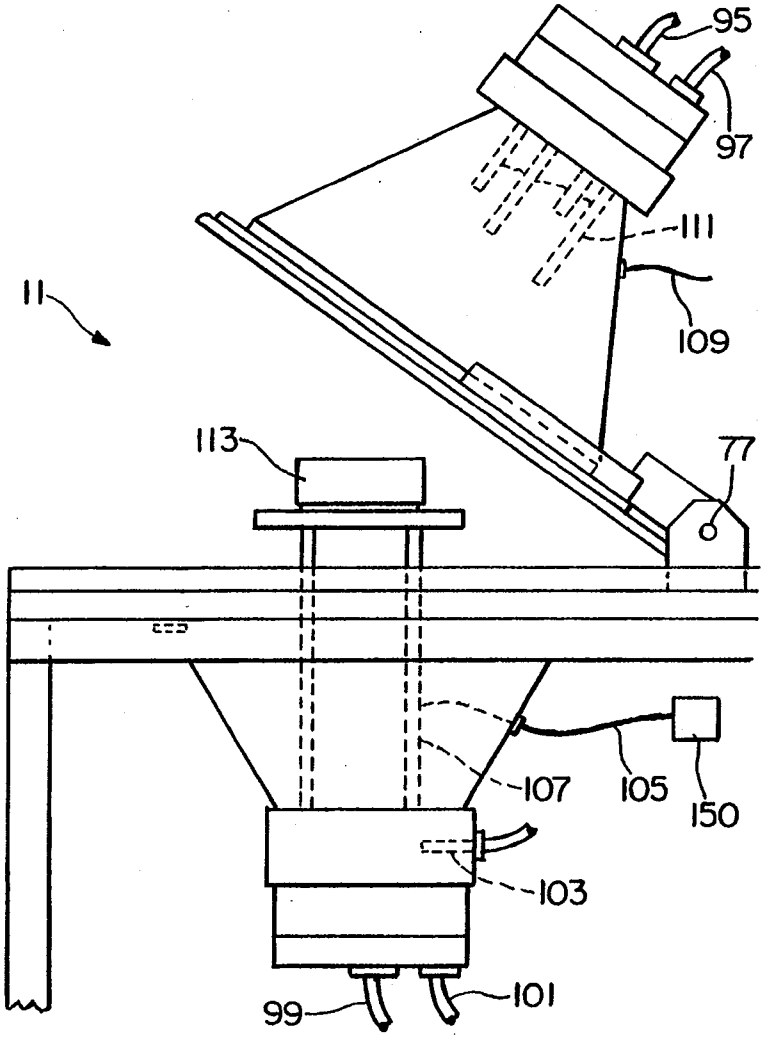
FIG. 2 is a side elevation view of an electrochemical chamber according to the present invention in an opened position.
Figure 3:
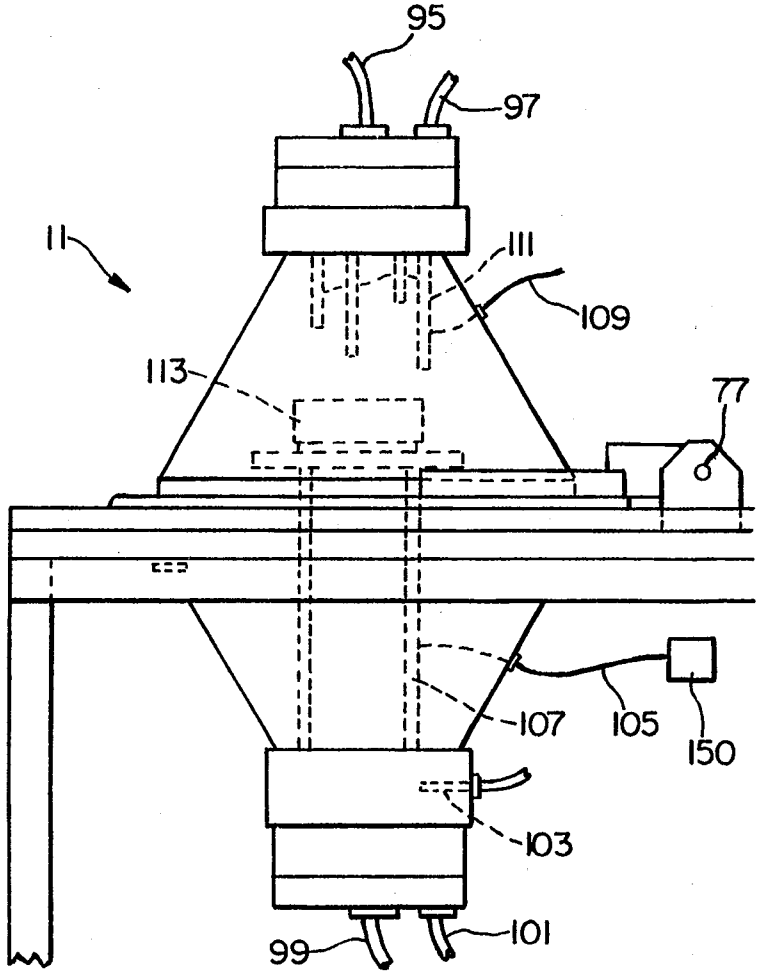
FIG. 3 is a side elevation view of the electrochemical chamber of FIG. 2 in a closed position.

The electrochemical processing system shown in FIG. 1 is centered around a single chamber 11 which is connected by a plurality of storage tanks 15, 17, 19, and 21 which contain a variety of liquids. The single chamber 11 is formed from a pair of like-size hollow frustoconical halves which are sealed by joining base to base to form a sealed electrochemical processing enclosure, see FIGS. 2 and 3. The two halves are hinged as at 77 so that the top may be raised as indicated in FIG. 2 and workpieces 113 can be easily placed therein. This workpiece 113 is supported on a Titanium anode 107 which has an electrical lead 105 connected to either a direct or alternating current power source 150. Cathode electrodes 111 located in the top half of the frustoconical half are connected with the other lead 109 can varied in size and location to accommodate the workpiece 113 to assure that a sealed chamber 11 is produced.

In the electrochemical processing system shown in FIG. 1, chamber 11 sequentially receives heated de-ionized water from storage tank 15, nitric acid cleansing solution (desmutter) from tank 17, Sulfuric acid from tank 19 and rinse water from tank 21 in response to timing of valves 31, 29, 27 and 25, respectively and the operation of pump 13. Chamber 11 is also connected to recirculation pump 33 whose operation is tied to valves 39, 41 and 43 and to a drain valve 55. Drain valve 5 is connected to pumps 57, 59 and 61 for returning fluid to tanks 17, 15 and 19 in response to operational signals from a central processing unit 150 which controls the timing of the valves for the delivery and draining of chamber 11.

PREFERRED PROCESS FOR ANODIZING AN ALUMINUM WORKPIECE

The workpiece 113 is placed on anode 107 and the top half of chamber 11 brought into a position to form a sealed chamber as shown in FIG. 2. Signals from the central processing unit (cpu) 150 activate valve 29 and pump 13 to allow Nitric acid solution (desmutter) to flow from tank 17 into the sealed chamber 11. When the correct level of fluid is in chamber 11, valve 29 is closed and air purge valve 47 is opened to clear or remove Nitric acid solution from pump 13 and lines 81 to prevent contamination of the next process fluid. When pump 13 is deactivated, the cpu 150 provides a signal which activates 39 to opens and turns on pump 33 to allow fluid to pass through line 101 then through 97 back to chamber 11. This allows recirculation of the Nitric acid solution provides for agitation in chamber 11 and facilitates more efficient cleaning of the workpiece 113. After a predetermined amount of time, the operational signal to pump 33 and valve 39 is terminated and a signal supplied to open drain valve 55 to direct the Nitric acid solution to reservoir 53. When the Nitric acid solution has drained from chamber 11 and drain valve 55 closed, the cpu 150 supplies a signal to air purge valve 45 opens and directs pressurized air to allow clearage of lines 83, 101 and pump 33 to prevent contamination of subsequent process fluids. The Nitric acid solution is now pumped from reservoir 53 by pump 57 through filter 67 back to starting vessel 17 to complete the first step in the anodizing process.

On completion of the first step, the cpu 150 supplies a signal which opens valve 25 and activates pump 13 to allow rinse water from storage tank 21 to flow through line 81 into chamber 11. When chamber 11 is substantially full or at least above the workpiece 113 and cathode 111, valve 25 is closed and valve 47 opened to allow air to flow in line 81 and pump 13 any purge rinse water therefrom. After the purging, the cpu 150 sends a signal which opens valve 39 and activates pump 33 to recirculate of rinse water in chamber 11 by way of lines 101 and 97. This recirculation creates agitation to facilitate more efficient rinsing. After a specified amount of time, the signal to pump 33 and valve 39 terminates and the cpu 150 communicates a signal which opens drain valve 55 and to allow the rinse water to drain from chamber 11 through line 99 to the drain valve for distribution to a waste water holding tank by line 79. When the rinse water has drained from chamber 11, the signal from cpu 150 closes drain valve 55 to complete this second step in the anodizing process. Thereafter, the cpu 150 sends a signal which opens valve 45 and allows air to purge lines 83, pump 33 and 101 to remove any rinse water therefrom that may effect a subsequent step in the anodizing process.

On completion of the second step, the cpu 150 supplies a signal which opens valve 27 and activates pump 13 to allowing a Sulfuric acid solution to flow from storage tank 19 through line 81 to chamber 11. During the filling of chamber 11, valve 43 is opened and pump 33 turned on to allow the Sulfuric acid solution to circulate through chiller 35 via lines 101 and 97. A valve 14 responsive to thermometer 103 located in chamber 11, controls the flow of the Sulfuric acid solution through chiller 35 to keep the Sulfuric acid at a constant temperature of about 72 degrees Fahrenheit. When the level of the Sulfuric acid solution in chamber 11 reaches a predetermine level above the workpiece 113 and over the cathodes 111, valve 27 is closed and pump 13 turned off. Thereafter, current flow from a source of supply is initiated in line 105 to anode 107 as a result of a signal from cpu 150 to start the oxide formation process. After a determined amount of time of about 20 minutes to two hours depending on the desired thickness of the coating, the cpu 150 turns off the current flow to the anode 107, the operating signal to pump 33 is terminated and supplies a signal which opens drain valve 55 to communicate the Sulfuric acid solution to reservoir 49. At the same time, valves 45 and 47 are opened to allow air to purge any Sulfuric acid solution from lines 81, 83, 101 and pumps 33 and 13 to prevent contamination of any subsequent fluid that may be used in the anodization process. When all of the Sulfuric acid solution is removed from the system, the cpu 150 provides a signal which closes drain valve 55 to complete a third step in the anodizing process. When the level of the Sulfuric acid solution in reservoir 49 reached a predetermined level as determined by sensor 70, pump 61 is turned on and after passing through filter 63, Sulfuric acid is returned to storage tank 19.

After the Sulfuric acid solution is removed from chamber 11, a reaction may continue on the surface of the workpiece and in order to terminate the anodizing of the workpiece 113, the workpiece is rinsed with water in a manner set forth above in step two to define a step four in the anodizing process. After the rinse water has been circulated for about five minutes, the rinse water has diluted the Sulfuric acid solution of the surface of the workpiece such that all reaction has ceased and the cpu after turning off recirculating pump 33, opens valve 55 to allow the rinse water to flow through line 79 to a waste water holding tank to complete step four.

In order to set or seal the anodic film formed on the workpiece 113, the cpu 150 supplies a signal which opens valve 31 and activates pump 13 to allow heated de ionized water to flow from tank 15 to chamber 11. As the de ionized water enters chamber 11, cpu 150 supplies a signal which activates pump 33 and opens valve 41 to allow the water to circulate from chamber 11 to heater 37 by way of lines 101 and 97. then the fluid level in chamber 11 reaches a level above the workpiece 113, a signal from cpu 150 turns off valve 31 and deactivates pump 13. The heater 37 maintains the temperature of the de ionized water above 210 degrees F. and after a predetermined amount of time greater than thirty minutes the anodic film Should be sealed on the surface of workpiece 113. When the curing or setting time has been completed, cpu 150 sends a signal which terminates the operation of pump while opening drain valve 55 to allow communication of the de ionized water to reservoir 51. At the same time, valves 47 and 45 are opened and air communicated through lines 83, 81 and 101 as well as pumps 13 and 33 to purge any de ionized water therein back into chamber 11. As the de ionized water drains from chamber 11, cpu 150 or fluid level sensor switch in reservoir 51 activates pump 59 and after passing through filter 65 the de ionized water is returned to storage tank 15 to complete this step five in the anodizing process. After the de ionized water has been removed from chamber 11, a signal from cpu 150 closes valve 55 to complete step five of the anodization process. Thereafter, the top half of chamber 11 is pivoted on hinge 77 and the anodized workpiece 113 removed.

All storage tanks and reservoirs 49, 51, 53, 15, 17, 19 and 21 have drain valves such as 73, and 75 and level indicators 69 and 71 respectively to provide for control of the amount of fluid retained therein. The level indicators 69 and 71 may be connected to an automatic make up means or light indicators on an operator panel associated with the cpu 150 to provide an operator with an indication of the activity within the anodizing system. Further, valves 43, 41, and 39; lines 83, 101, and 97; valves 31, 29, 27 and 25; line 81 and pumps 13 and 33 are mounted on an angle such to facilitate more efficient draining of process fluids between the various steps in the anodizing process.

In order to provide for a module concept it is envisioned that additional electrochemical chambers 85 may be connected in series or parallel with electrochemical chamber 11 and additional workpieces 113' may be anodized at the same time, If chambers 11 and 85 are connected in series the fluid would flow from line 101 through line 93 and line 97 through line 89 to connect pump 33 and associated recirculating valve 39, heater valve 41 and chiller valve 43 and simultaneous perform the various steps in the anodizing process. However, chambers 11 and 85 are to be operated in parallel, line 87 would be connected to pump 13 and line 91 allow the fluids to bypass chamber when connected for independent operation by pump 33, recirculating valve 39, heater valve 41 and chiller valve 43.

We claim:

1. An electrochemical processor for providing a coating on a workpiece comprising:

a first chamber for receiving said workpiece;

a plurality source of process liquids;

means for selectively supplying said liquids to said first chamber;

valve means for selectively supplying a first liquid from said plurality source of process liquids to said first chamber for initial workpiece processing and drainage of said first liquid from said first chamber and sequentially supplying to and draining a second, third, and fourth liquid from said plurality source of process liquids from said first chamber to protect said workpiece without removal of said workpieces from said first chamber;

a recirculating system connected to said first chamber for selectively supplying for withdrawing process liquid from said the first chamber, treating said process liquid, and subsequently returning said process liquid to said first chamber; and means for maintaining the temperature of the liquid communicated to said first chamber at a predetermined temperature.

2. The electrochemical processor of claim 1 further comprising:

a second chamber for receiving workpieces to be processed, said second chamber being selectively connected in parallel with the said first chamber whereby said first chamber and said second chamber may each independently receive process liquids and whereby said process liquids may each be selectively and independently drained from each of said first and second chambers in response to operation of said valve means.

3. The electrochemical processor of claim 2 wherein said valve means selectively couples first and second chambers to said recirculation system.

4. The electrochemical processor of claim 1 wherein said recirculating system further includes:

means for receiving said first, second, third and fourth liquids from said first chamber and returning said first, second, third and fourth liquids to an original storage tank without being contaminated by each other.

5. The electrochemical processor of claim 1 further including:

cathodes located in said chamber; and means for replacing said cathodes as a function of the selected fluid to perform the anodization of the workpiece.

6. An electrochemical processor for providing a coating on a workpiece comprising:

a first chamber having first and second frustoconical halves joined at their bases to form a sealed electrochemical processing enclosure for receiving said workpiece;

a plurality source of process liquids;

means for selectively supplying said liquids to said first chamber;

valve means for selectively supplying a first liquid from said plurality source of process liquids to said first chamber for initial workpiece processing and drainage of said first liquid from said first chamber and sequentially supplying to and draining a second, third, and fourth liquid from said plurality source of process liquids from said first chamber to protect said workpiece without removal of said workpieces from said first chamber.

7. The electrochemical processor of claim 6 further comprising:

means for receiving said first, second, third and fourth liquids from said first chamber and returning said first, second, third and fourth liquids to an original storage tank without being contaminated by each other.

8. The electrochemical processor of claim 6 further comprising:

a recirculating system connected to said first chamber for selectively supplying for withdrawing process liquid from said the first chamber, treating said process liquid, and subsequently returning said process liquid to said first chamber.

9. The electrochemical processor of claim 6 further comprising:

means for maintaining the temperature of the liquid communicated to said first chamber at a predetermined temperature.

10. The electrochemical processor of claim 6 further including:

cathodes located in said first chamber; and means for replacing said cathodes as a function of the selected fluid to perform the anodization of the workpiece.

11. The electrochemical processor of claim 6 further comprising:

a second chamber for receiving workpieces to be processed, said second chamber being selectively connected in parallel with the said first chamber whereby said first chamber and said second chamber may each independently receive process liquids and whereby said process liquids may each be selectively and independently drained from each of said first and second chambers in response to operation of said valve means.

* * * * *